US006382116B2

(12) United States Patent
Wakasugi

(10) Patent No.: US 6,382,116 B2
(45) Date of Patent: May 7, 2002

(54) EMBROIDERY MACHINE AND EMBROIDERY FRAME HOLDING DEVICE

(75) Inventor: Kazuhisa Wakasugi, Obu (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/805,971

(22) Filed: Mar. 15, 2001

(30) Foreign Application Priority Data

Mar. 15, 2000 (JP) ..... 2000-072919

(51) Int. Cl.[7] ..... D05C 9/04
(52) U.S. Cl. ..... 112/103
(58) Field of Search ..... 112/103, 470.14; 38/102.2, 102.91

(56) References Cited

U.S. PATENT DOCUMENTS 4,944,105 A * 7/1990 Schulle ..... 38/102.2
5,249,537 A * 10/1993 Sakakibara ..... 112/103
5,327,665 A * 7/1994 Manning et al. ..... 38/102.2
5,330,143 A * 7/1994 Rich et al. ..... 38/102.2

FOREIGN PATENT DOCUMENTS

JP 8-246324 9/1996
JP 9-302568 11/1997

* cited by examiner

*Primary Examiner*—Ismael Izaguirre
(74) *Attorney, Agent, or Firm*—Oblon, Spivak, McClelland, Maier & Neustadt, P.C.

(57) ABSTRACT

A embroidery machine 2 has a first arm 3R in which a part of an embroidery frame 1 may be held, and a second arm 3L projecting in the same direction as the first arm, and in which another part of the embroidery frame 1 may be held. A long guide holding part 5 as extends in a direction to intersect with the direction by which the first arm 3R and the second arm 3L project. At least one of the first arm 3R and the second arm 3L can slide on the long guide holding part 5 such that a spacing M between the first arm 3R and the second arm 3L may be varied. A releasable fixing device is mounted to releasably fix at least one of the first arm and the second arm in at least one desired position on the guide holding part.

32 Claims, 8 Drawing Sheets

EMBROIDERY MACHINE AND EMBROIDERY FRAME HOLDING DEVICE

CROSS REFERENCE TO RELATED APPLICATIONS

The present application is based on Japanese application no. 2000-072919, filed on Mar. 15, 2000, which is herein incorporated by reference in its entirety.

BACKGROUND OF THE INVENTION

1. Field of the Invention

The invention relates to an embroidery machine and an embroidery frame holding device.

2. Discussion of the Background

Japanese Patent Laid-open Print No. Hei.9 (1997)-302568 discloses an embroidery machine which has an embroidery frame holding device which permits the embroidery frame to be attached or removed for exchanging the cloth to be embroidered. This embroidery frame holding device has an arm holding body, as well as first and second arms. The spacing from the first arm to the second arm is constant. This device has a long side portion, and a user can control the position of the arm holding body by moving it along a side slot. In this device, the spacing between the first arm and the second arm cannot be changed. Therefore, the holding body cannot accommodate different sized embroidery frames.

Japanese Patent Laid-open Print No. Hei.8 (1996)-246324 discloses an embroidery machine which has an embroidery frame holding device which permits an article to be embroidered, such as a cloth, to be attached or removed. This embroidery frame holding device has a first arm which projects along one direction and makes it possible to attach and remove parts of the embroidery frame, and a second arm which projects along the one direction and makes it possible to attach and remove other parts of the embroidery frame. This device has a separate first arm and second arm. The base of the embroidery frame holding device has a first installation hole and an adjoining second installation hole. The first arm may fit the first installation hole; the first arm fits the second installation hole when user fit an embroidery frame having a different width. But this device can only accommodate two sizes of embroidery frames.

A need exits to overcome the aforementioned problems, and to provide an embroidery machine and embroidery frame holding device which can accommodate embroidery frames of various sizes.

SUMMARY OF THE INVENTION

Accordingly, the first aspect of the present invention is to provide the embroidery machine comprising a embroidery frame holding device including a first arm which projects in a first direction and which is adapted to hold a part of an embroidery frame, and a second arm which projects in said first direction and which is adapted to hold another part of the embroidery frame; a guide holding part which is elongated in a second direction which intersects said first direction; at least one of the first arm and the second arm being slidably mounted on the guide holding part for movement in said second direction such that a distance between the first arm and the second arm may be varied; and a releasable fixing device mounted to releasably fix at least one of the first arm and the second arm in at least one desired position on said guide holding part.

According to the embroidery machine in the present invention, at least, one side of the first arm and the second arm is movable and can slide such that the spacing of the first arm and the second arm is continuously variable along the length of the long guide holding portion. Therefore, when a user embroiders, if the user wishes to use a different size embroidery frame, either the first arm or the second arm is made to slide along the length of the long guidance holding device. In other words, the spacing of the first arm and the second arm is made small when user uses a small embroidery frame. When user uses a mid sized embroidery frame, the spacing of the first arm and the second arm is made mid sized. When user uses a large embroidery frame, the spacing of the first arm and the second arm is made large.

Accordingly, the third aspect of the present invention is to provide a embroidery frame holding device including a first arm which projects in a first direction and which is adapted to hold a part of an embroidery frame, and a second arm which projects in said first direction and which is adapted to hold another part of the embroidery frame; a guide holding part which is elongated in a second direction which intersects said first direction; at least one of the first arm and the second arm being slidably mounted on the guide holding part for movement in said second direction such that a distance between the first arm and the second arm may be varied; and a releasable fixing device mounted to releasably fix at least one of the first arm and the second arm in at least one desired position on said guide holding part.

According to the embroidery frame holding device in the present invention, at least, one side of the first arm and the second arm is movable and can slide such that the spacing of the first arm and the second arm is continuously variable along the length of the long guide holding portion. Therefore, when a user embroiders, if the user wishes to use a different size embroidery frame, either the first arm or the second arm is made to slide along the length of the long guidance holding device. In other words, the spacing of the first arm and the second arm is made small when user uses a small embroidery frame. When user uses a mid sized embroidery frame, the spacing of the first arm and the second arm is made mid sized. When user uses a large embroidery frame, the spacing of the first arm and the second arm is made large.

By the above embroidery machine and the embroidery frame holding device, only one of the first arm or the second arm is movable, or both of the first arm and the second arm are independently movable, along the length of the long guide holding portion.

The embroidery frame holding device of this invention may be included in an The embroidery machine specifically designed for it, or it may be retrofitted to an existing embroidery machine.

According to this invention, the guide holding part includes a high use arm position distinguishing device for at least one of the first arm and the second arm. In this case, a user can quickly set the arms to a high use position. The high use arm position distinguishing device can be visual, auditory or tactile, or a combination thereof.

One side can slide, for example between ¼ to 5 times the length of movement of the other side. The long guide holding part can comprise the first long guide holding portion for sliding the first arm and the second long guide holding portion for sliding the second arm. The first long guide holding portion may have a length of between ¼ to 5 times or ⅓ to 3 times that of the first arm, and the second long guide holding portion length may be between ¼ to 5 times or ⅓ to 3 times that of the second arm.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

First Embodiment

Referring to FIGS. 1 and 10–12, an embroidery frame 1 is formed by an inner frame 10 which has a ring frame-shape, and the outer frame 11 that has a ring frame-shape, and that the user can removably install on the inner frame 10. The user places the material to be embroidered between the internal circumference of the outside frame 11 and the outer circumference of the inner frame 10.

Figure 1:
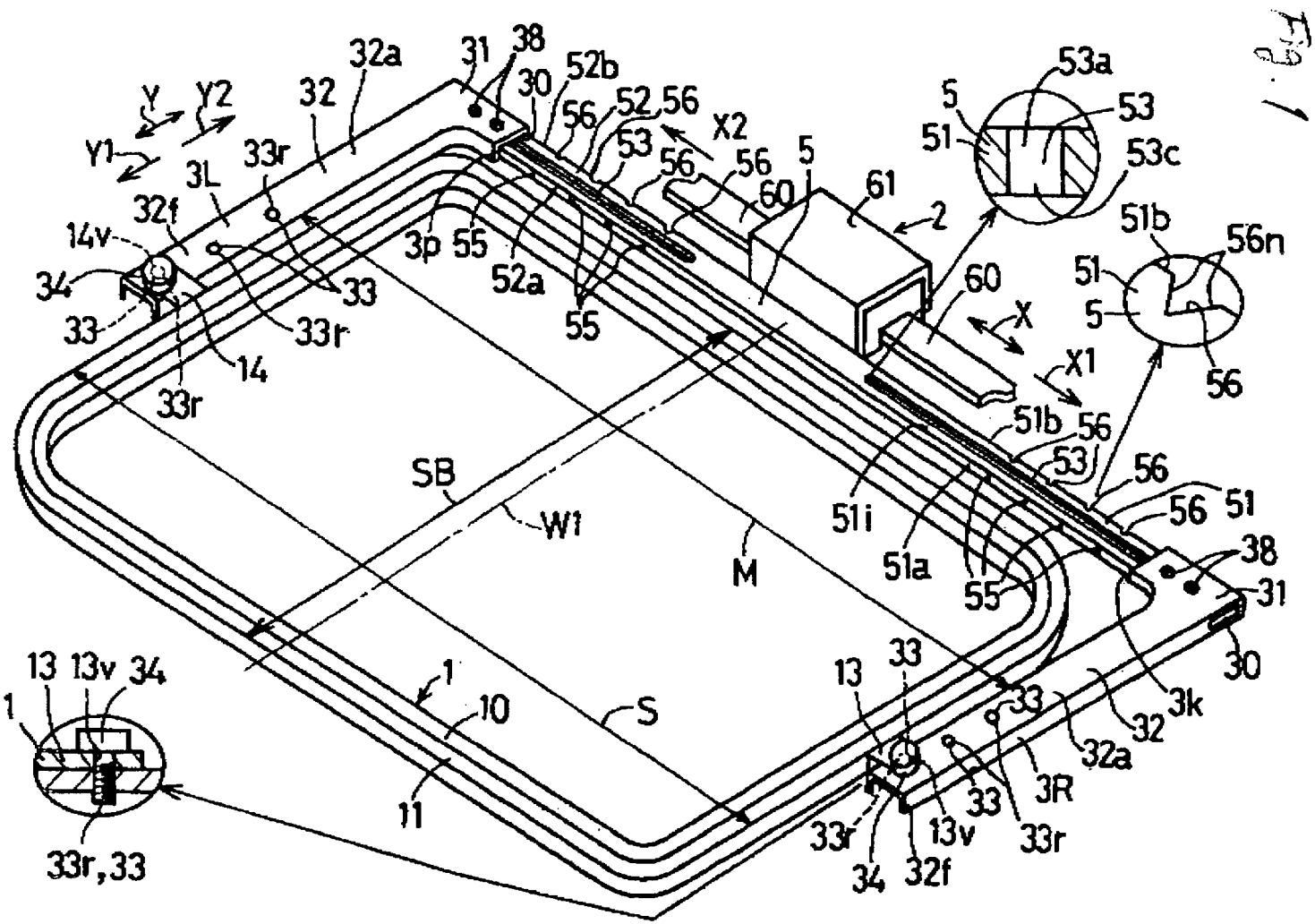
FIG. 1 is an overall perspective view of an embroidery frame holding device of a first embodiment of the invention, holding an embroidery frame, and showing details of important parts of the embroidery frame holding device.

An installation element 13, of sword guard form, projects outwardly from a part of the outside frame 11 extending in the width direction (the direction along SB of the FIG. 1). The other installation element 14, of sword guard form, projects outward in the opposite direction. The installation elements have insert holes 13*v*, 14*v* which go through the installation elements 13, 14 in the thickness directions thereof.

An embroidery frame holding device 2 is supplied on the embroidery machine, or it may be retrofitted on an existing embroidery machine. As shown in the FIG. 1, the embroidery frame holding device 2 has movable first arm 3R, a movable second arm 3L and a long guide holding part 5 held by the embroidery machine. The first arm 3R projects along the Y1 direction which is one direction, and the first installation element 13 of the embroidery frame 1 is removably mountable thereon. The second arm 3L projects along the YI direction, and the second installation element 14 of the embroidery frame 1 is removably mounted thereon.

The long guide holding part 5 is rail-shaped, and extends along the X direction (X1/X2 direction), which crosses the projection direction of the first arm 3R and the second arm 3L at right-angles. According to the present invention, the position in the X direction, and along the long guide holding part 5, where the first arm 3R and the second arm 3L project is movable.

In the embroidery machine of this embodiment, a horizontal guide rail 60 is positioned in parallel along the long guide holding part 5 and along the direction X1/X2. The guide rail 60 is mounted to the embroidering machine so as to move back and forth in the Y direction (Y1/Y2 direction), and can stop at an optional position in the Y direction.

A movement part 61 is movably mounted on the guide rail 60 for movement in the X direction, and is connected to an X direction drive mechanism (not shown) of the embroidery machine. The X direction drive mechanism may have an endless timing belt which connects to the movement part 61 and to a source of X drive, generally a motor, which operates the timing belt. When the source of X drive operates, the timing belt circulates and the movement part 61 can be moved in the X direction (X1/X2 direction) along the guide rail 60, and can stop at any position in the X direction.

The long guide holding part 5 is unitarily mounted to the movement part 61. Therefore, as the movement part moves along the X direction (X1/X2 direction), the long guide holding part 5 moves therewith along the X direction. The long guide holding part 5 has a constant cross section, which may be rectangular and elongated in the arrow Y direction.

The long guide holding part 5 is constructed by the first long guide holding portion 51 which extends along the X1 direction and the second long guide holding portion 52 which extends along the X2 direction. Therefore, the first long guide holding portion 52 and the second long guide holding portion 52 extend opposite each other.

As shown in FIG. 1, the upper surface of the first long guide holding portion 51 has a slot 53 which extends along the length direction in a straight line. The slot 53 goes through the thickness of the first long guide holding portion 51 and has openings at the upper surface 53*a* and the lower surface 53*c* of the first long guide holding portion 51. The opening at the upper surface and the opening at the lower surface become longer along the length direction of the first long guide holding portion 51.

As shown in FIG. 1, the front side 51*a*, i.e., the side facing the user, of the first long guide holding portion 51 has a plurality of vertical line-shaped marks 55 at fixed intervals, which function as visual datum lines. The marks 55 distinguish high frequency use positions of the first arm 3R, and so provide arm position distinction means. The back surface of the first long guide holding portion 51 has multiple detents at predetermined spacings. Each detent 56 is a triangular groove in cross section, which has right and left planar surfaces 53*n* (like an isosceles triangle). The detents 56 insure that the first arm 3R is correctly positioned, and also function to discriminate a position of a second arm.

Figure 2:
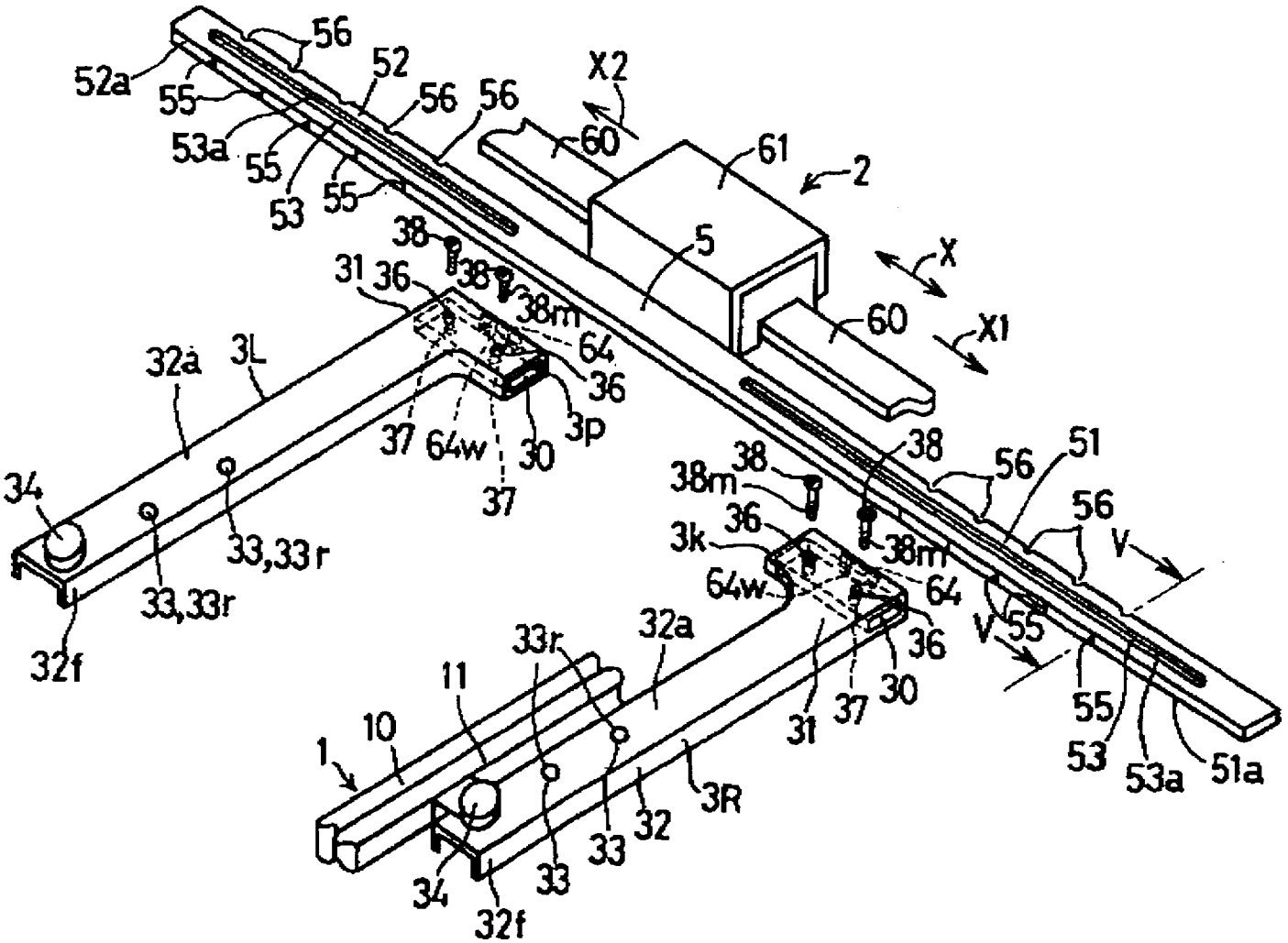
FIG. 2 is a perspective view of an important part of the embroidery frame holding device of the first embodiment of the invention.

As shown in FIG. 2, the first arm 3R has a base 31 which has a through hole 30, and a main arm 32 united with the base and extending horizontally in the Y1 direction from the base 31. The first arm 3R has an overall L shape. The through hole 30 of the first arm 3R is rectangular and is elongated in the Y direction, so as to closely fit the opposite sides of the first long guide holding portion 51, which is slidably fit therein such that the first arm 3R can move along the direction of length of the first long guide holding portion 51.

Therefore the through hole 30 and the long guide holding part 5 are rectangular and elongated in the Y direction, and the through hole 30 and the long guide holding part 5 are close fitting, so that the tip of the main arm 32 of the first arm 3R does not droop excessively.

Provided at predetermined spacings, in the Y direction, in the top wall 32*a* of the main arm 32 of the first arm 3R are a number of threaded fitting holes 33. A thumb screw 34 is threaded to the first arm 33R via its screw threads 33*r* which mate with the screw threads of one of the fitting holes 33.

Figure 5:
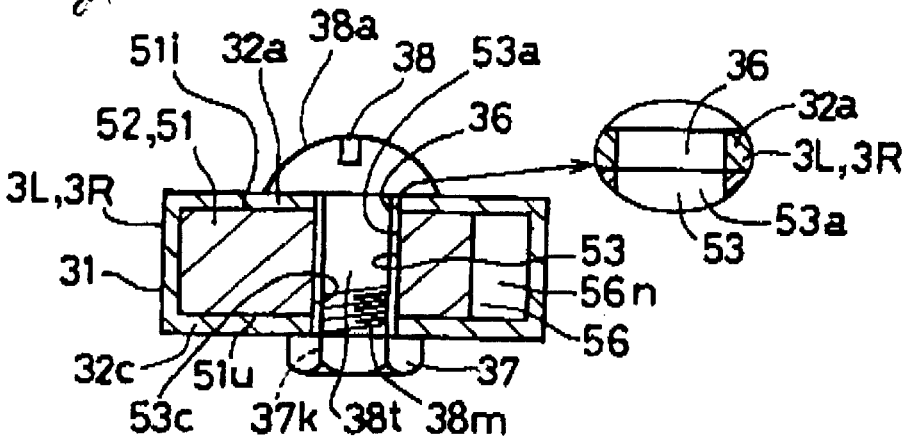
FIG. 5 is a sectional view taken along line V—V in FIG. 2.

As shown in FIG. 5, which is a section seen along line V—V of FIG. 2, the top wall 32*a* of the first arm 3R of base 31 has a plurality of round unthreaded arm fixation holes 36 extending therethrough. As also shown in FIG. 5, at the bottom wall 32*c* of the first arm 3R is mounted a fixation element 37. This fixation element 37 may be a nut 37*k* welded to the bottom surface wall 31*c* of the first arm 3R. However, it may instead be a tubular threaded wall. Each arm fixation hole 36 of the first arm aligns with the slot 53 of the first long guide holding portion 51. Accordingly, as the base portion 31 of the first arm slides along the first long guide holding portion 51 in the direction X1/X2, the arm fixation hole 36 of the first arm 3R faces the slot 53 of the first long guide holding portion 51.

As shown in FIG. 5, an arm fixation screw 38 extends through the arm fixation hole 36 of the first arm 3R from the upper side of the first arm 3R. The arm fixation screw 38 has a screw shaft 38*t* having a screw thread 38*m* and a head 38*a* connected with one end of screw shaft 38*t*. The screw thread 38m of screw shaft 38*t* is threaded into nut 37*k*.

As it is understandable from FIG. 5, if the user rotates head 38*a* of the arm fixation screw 38 using a tool, the thread 38*m* of screw shaft 38*t* tightens on the nut 37*k*. As a result the distance between fixation element 37 and head 38*a* of arm fixation screw 38 is shortened. And the top surface wall 32*a* of the first arm 3R presses on the top surface 51*i* of the first long guide holding portion 51, and the bottom surface wall 32*c* of the first arm 3R presses on a bottom surface 51*u* of the first long guide holding portion 51. Consequently the first arm 3R is fastened without sliding to the first long guide holding portion 51.

In order to make the first arm 3R slide, user may loosen a head 38*a* of the arm fixation screw 38. By this action, a screw thread 38*m* of the screw shaft 38*t* is rotated within the nut 37*k*, the contact pressure will be loosened, and the first arm 3R can slide along the first long guide holding portion 51.

Figure 3:
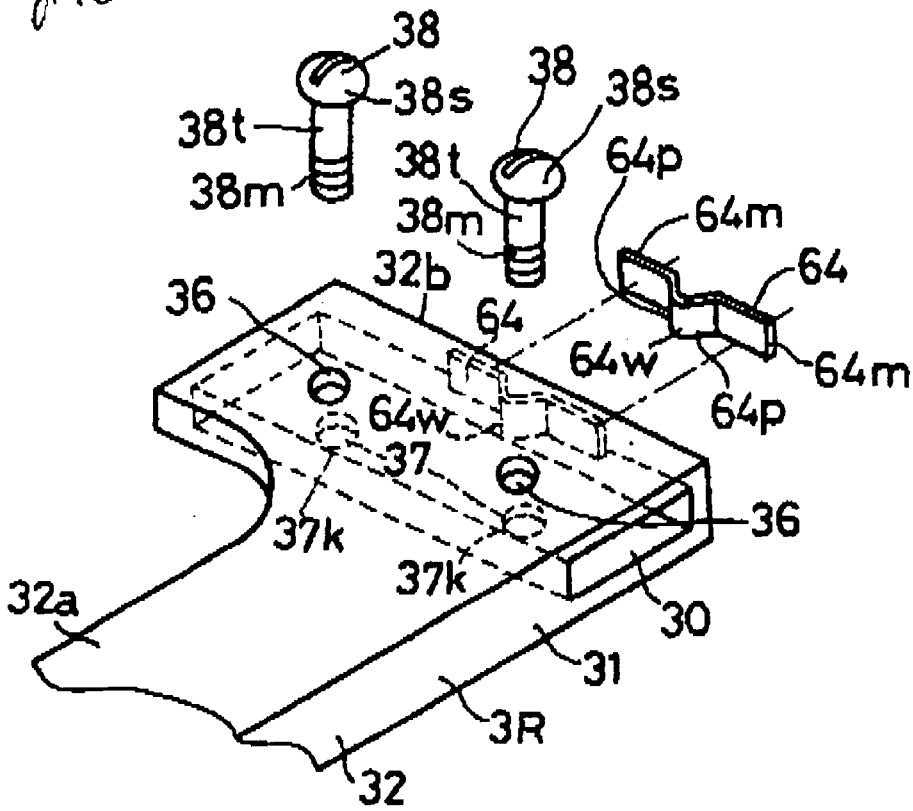
FIG. 3 is a perspective view of the base of an arm of the embroidery frame holding device of the first embodiment of the invention.
Figure 4:
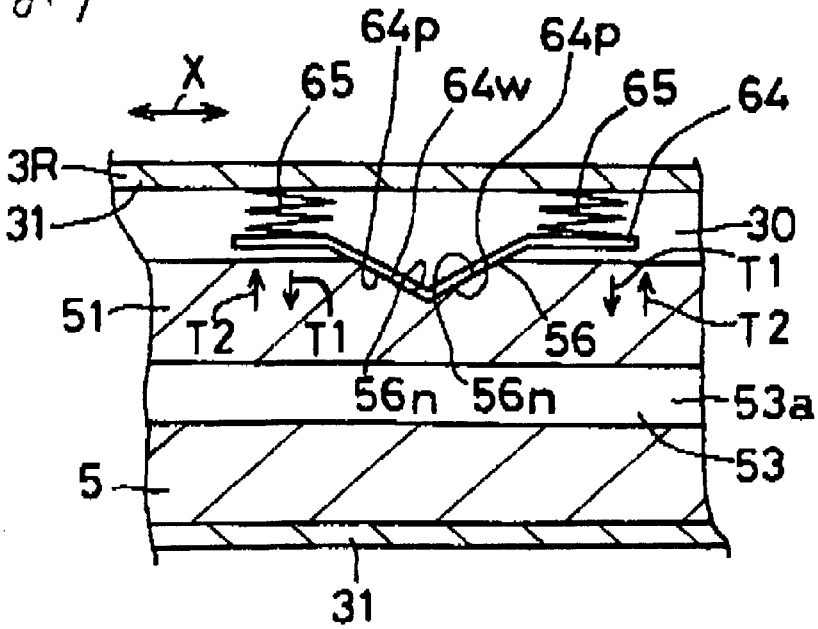
FIG. 4 is a sectional plan view of the base of an arm of the embroidery frame holding device of the first embodiment of the invention.

As shown in FIG. 3 and FIG. 4, a clamp 64 is provided at the back surface wall 32*b* of the base 31 of the first arm 3R. The clamp 64 is made of plastic or sheet metal, and has a flat plate portion 64*m* and a connecting protrusion 64*w*. The connecting protrusion 64*w* has a triangular shape (concretely, isosceles triangular shape) having inclined planes 64*p* with equal right and left hand sides.

As shown in FIG. 4, the connecting protrusion 64*w* of the clamp 64 protrudes at an empty space of through hole 30. The clamp 64 is held by a spring 65 in the base portion 31 of the first arm 3R. The spring 65 applies a force to the clamp 64 in the T1 direction, namely toward the long guide holding part 5. The connecting protrusion 64*w* of the clamp 64 can thereby enter and release from each of the multiple detents 56 on the first long guide holding portion 51.

Namely, when the first arm 3R slides in the X direction, the connecting protrusion 64*w*, being pressed toward the T1 direction by the spring 65, enters a detent 56 of the first long guide holding portion 51. This functions as a means for discrimination a tactile impression.

When the first arm 3R slides further in the X direction, as is understood from FIG. 4, an inclined plane 64*p* of the clamp 64 climbs up an inclined plane 55*n* of the detent 56, and the connection between a protrusion shape of the connecting protrusion 64*w* and the detent 56 is canceled.

When the connecting protrusion 64*w* of the first arm 3R is inserted in any of the detents, since an external force is required to make the first arm 3R slide in the X direction, unnecessary vibration of the first arm 3R will be brought under control. Accordingly the clamp 64 and the detent 56 act as a means to inhibit unnecessary vibration of the first arm 3R.

In this embodiment of the present invention, as shown FIG. 1, the second arm 3L has the same structure as first arm 3R, and is symmetrical relative to a virtual center line W1 of a moving part 61 in the direction X. Concerning the second long guide holding portion 52 and the first long guide holding portion 51, their structures are symmetrical relative to the virtual center line W1 of a moving part 61.

As shown in FIGS. 1 and 2, a slot 53 extends an the top surface of the second long guide holding portion 52. Marks 55 which function as a means of position discrimination are provided at predetermined intervals on a front surface 52*a* of the second long guide holding portion 52. The marks 55 can be used to distinguish positions of high frequency use of the second arm 3. Multiple detents 56 are made at predetermined intervals at the back surface 52*b* of the second long guide holding portion 52. The second arm 3L also has a base 31 with a through hole 30 along the X direction, and a main arm 32 extending from the base portion 31 along the Y1 direction. The overall form of the second arm 3L is also L-shaped. The through hole 30 of the second arm 3L fits the rectangular sides of the second long guide holding portion 52, which sides are elongated in the Y direction, and the second arm 3L slides the length direction along the second long guide holding portion 52. The through hole 30 of the second arm 3L and the second long guide holding portion are rectangular and elongated in the Y direction and close fitting, so that the tip of the main arm 32 of the second arm 3L does not droop excessively.

As shown in FIG. 5, the arm fixation hole 36 in the top wall 32*a* of the base portion 31 of the second arm 3L, can face the slot 53. The arm fixation screw 38 extends through the arm fixation hole 36 from the upper side of the second arm 3L. As shown in FIG. 1, the top wall 32*a* of the main arm 32 of the second arm 3L has a plurality of the fitting holes 33 with screw threads 33*r*. The thumbscrew 34 is threadable in the fitting hole 33.

As shown in FIG. 2, the back side of the base portion 31 of the second arm 3L is has a clamp 64. When the connecting protrusion 64*w* of the clamp 64 is connected with any of the detents 56, as an external force is required to make the second arm 3L slide, and so unnecessary vibrations of the second arm 3L will be brought under control As shown in FIG. 1, when user embroiders, the first installation element 13 of the embroidery frame 1 may be fixed to the first arm 3R via a thumbscrew 34, and the second installation element 14 of the embroidery frame 1 may fixed to the second arm 3L via a thumbscrew 34. Therefore the a clearance M between the first arm device 3R and the second arm 3L is adjusted accordingly with a width size of embroidery frame 1.

In this embodiment of the present invention, by loosening an arm fixation screw 38 of the first arm 3R and second arm 3L, either of the first arm 3R or second arm 3L can slide on the long guide holding part 5. Namely, a clearance M between the first arm device 3R and the second arm 3L is movable to adjust the width of the embroidery frame 1. The user then slides either one, or both, of the first arm 3R or second arm 3L by hand in a direction X1/X2 along the long guide holding part 5. In this way the position of the first arm 3R and second arm 3L in the direction X corresponds to the size of the embroidery material 1.

After the position of the first arm 3R and the second arm 3L are set, the first arm 3R and second arm 3L can be fixed to the long guide holding part 5 by tightening the arm fixation screw 38 of the first arm 3R by a tool onto the fixation element 37, as the top wall 32*a* and the bottom wall 32*c* press on the first long guide holding portion 51. In the same way, the second arm 3L is fixed to the second long guide holding portion 52 by the arm fixation screw 38 of the second arm 3L tightening on the fixation element 37, and the second arm 3L also cannot slide along the second long guide holding portion 52.

When the embroidery frame 1 connects to the first arm 3R and the second arm 3L, the user selects a suitable fitting hole 33 to adjust to the depth SB of the embroidery frame 1. The screw thread 33*r* then extends through the 13*v* and screws into the fitting hole 33. The fixation of the second fixation element 14 of the second arm 3L is the same.

As above explain, when the first arm 3R and the second arm 3L are fixed to the embroidery frame 1, the user can embroider a cloth. In this case, the embroidery frame 1 and cloth need to move the Y direction and the X direction. In this case, if the guide rail 60 moves back and forth in the Y1/Y2 direction, the first arm 3R and the second arm 3L connected with the long guide holding part 5, the embroidery frame 1 and the cloth connected with the embroidery frame 1 move in the Y direction (Y1/Y2 direction).

If the movement part 61 moves along the guide rail in the direction X1/X2, the long guide holding part 5 held by the movement part 61, the first arm 3R and the second arm 3L connected with the long guide holding part 5 and the embroidery frame 1 move in the Y direction (Y1/Y2 direction), and embroidery can be performed.

As above explain, in this embodiment of the present invention, as the first arm 3R and the second arm 3L slide along the direction X1/X2, a clearance M between the first arm 3R and the second arm 3L is adjusted continuously. Therefore the embroidery frame 1 may have different widths S, or for a size corresponding to the user's favorite size, the first fixation element 13 of the embroidery frame 1 can clamp the first arm 3R and the second fixation element 14 of the embroidery frame 1 clamp the second arm 3L. Namely, the embroidery frame 1 can clamp the first arm 3R and the second arm 3L. So any width size S, from a small width size to a big width size, can be adapted for the embroidery frame.

In addition to this embodiment of the present invention, multiple marks 55 showing the high frequency positions of use for the first arm 3R and second arm 3L are provided on the first long guide holding portion 51 and second long guide holding portion 52 as a means of arm position discrimination. As is understood from FIG. 1, the user can easily slide the arm devices to positions of high frequency use.

Especially in this embodiment of the present invention, as explained before, an clamp 64 is provided on the first arm 3R and the second arm 3L. When the first arm 3R and the second arm 3L slide, the connecting protrusion 64*w* in the shape of a convexity is inserted into one of the detents 56. Therefore a user who slides the first arm 3R and the second arm 3L by hand can sense when a high frequency use position is reached. In this embodiment, even if the user does not have the desire or time to examine the marks 55, the positions of high frequency use of the first arm 3R and the second arm 3L can be easily distinguished.

Further in this embodiment of the present invention, the connection and insertion of the connecting protrusion 64*w* in a detent 56 can be distinguished by the connecting noise. Therefore even if user does not have a will or time to recognize the marks 55, the positions of high frequency use of the first arm 3R and the second arm 3L, can be easily distinguished.

Further in this embodiment, the detents 56 have an isosceles triangular shape having equal inclined planes 53*n* at both right and left sides, and the connecting protrusion 64*w* of the clamp 64 is also an isosceles triangular shape having an inclined plane 64*p* having equal right and left sides. Therefore the extent of insertion and connection when the first arm 3R and the second arm 3L slide toward the direction X1 and toward the direction X2 can be equalized.

In addition to this embodiment of the present invention, the first arm 3R can slide along the first long guide holding portion 51, and the second arm 3L can slide along the second long guide holding portion 52. Namely, since both of the first arm 3R and the second arm 3L can slide, it is much easier to change the width size S of the embroidery frame 1.

In the case of mounting the embroidery material holding device 2 on an existing embroidery machine, the guide rail 60 and the moving portion 61 already present on the embroidery machine can be used, and it is practical to mount the long guide holding part 5 on the moving portion 61.

Second Embodiment

Figure 6:
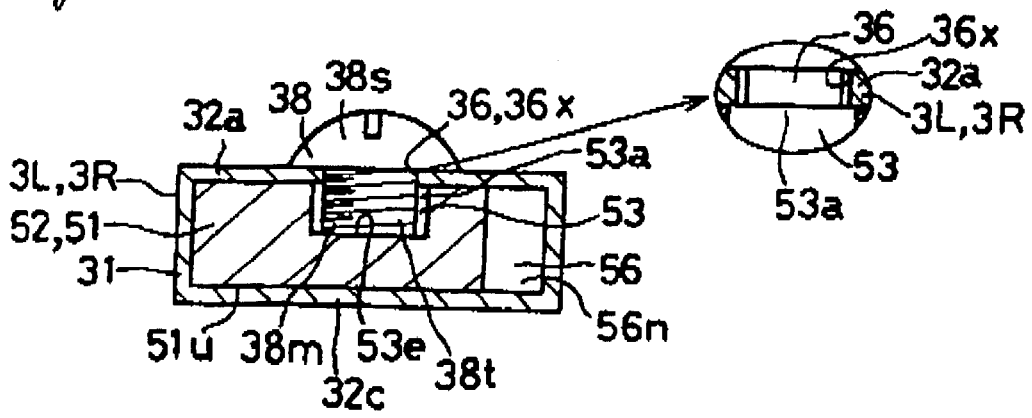
FIG. 6 is similar to FIG. 5 but shows a second embodiment.

The second embodiment of the present invention is shown by referring FIG. 6. The second embodiment is composed basically of the same structure as the first embodiment, and the common parts have common reference numbers. The second embodiment has basically the same advantageous effects. The different parts from the first embodiment will be explained hereunder.

In the second embodiment, the slots 53 in the first long guide holding portion 51 and second long guide holding portion 52, as shown in FIG. 6, have a top surface opening 53*a*, but do not go through to the bottom. Therefore the slots 53 have a base 53*e*. Internal threading 13*x* is provided at the inside wall surface of arm fixation hole 36.

As is understood from FIG. 6, when inserting the arm fixation screw 38 in the slot 53 from above, and tightening the head 38*s* of the arm fixation screw 38 by a tool to screw the fixation screw 38 into the screw thread 13*x* of the arm fixation hole 36, pressure is applied to the base 53*e* of the slot 53, and the bottom surface 51*u* of first long guide holding portion 51 is pressed strongly to the bottom surface wall 32*c* of the first arm 3R. As a result, the first arm 3R is fixed to the first long guide holding portion 51, and the first arm 3R cannot slide against the first long guide holding portion 51.

To permit the first arm 3R to slide, the arm fixation screw 38 is loosened by using a tool to rotate the screw 38. Fixation is thereby released, as the bottom surface 51*u* of the first long guide holding portion 51 releases pressure on the bottom surface wall 31*c* of the first arm 3R. The above explanation also applies to the second arm 3L.

Third Embodiment

Figure 7:
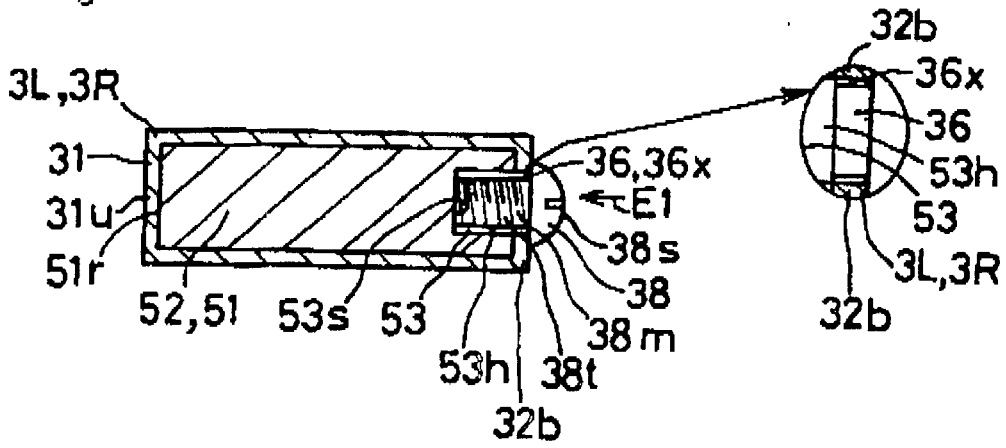
FIG. 7 is similar to FIG. 5 but shows a third embodiment.

The third embodiment of the present invention is shown referring FIG. 7. The third embodiment is basically the same as the first embodiment, and so the common parts are given the same reference numbers. The third embodiment has basically the same advantageous effect. The different parts from the first embodiment will be explained hereunder.

In the third embodiment of the present invention, the die slot 53 on the first long guide holding portion 51 is located at the back surface of the first long guide holding portion 51, as shown in FIG. 7. Namely the slot 53 has a back side opening, and the bottom surface 53*s* faces the side. The arm fixation hole 36 provided at the back surface wall 32*b* of the first arm 3R passes through and opens to the side, and an internal screw threading 13*x* is provided at the inside wall.

As shown in FIG. 7, when inserting the arm fixation screw 38 into the slot 53 from a side of the first long guide holding portion 51 and screwing the fixation screw 38 into the screw thread 13*x* of the arm fixation hole 38, pressure is applied to the base 53*s* of the slot 53, and the side surface Si r of first long guide holding portion 51 applies a pressure strongly to the side surface wall 31*u* on the base portion 31 of the first arm device 3R, as a result of which the first arm device 3R is fixed to the first long guide holding portion 51 and cannot slide against the first long guide holding portion 51.

The above explanation also applies to the second arm 3L. To permit the second arm 3L to slide, the arm fixation screw 38 is loosened by using a tool to rotate the screw 38. Fixation is thereby released, as the second arm 3L releases pressure on the second long guide holding portion 52.

Fourth Embodiment

Figure 8:
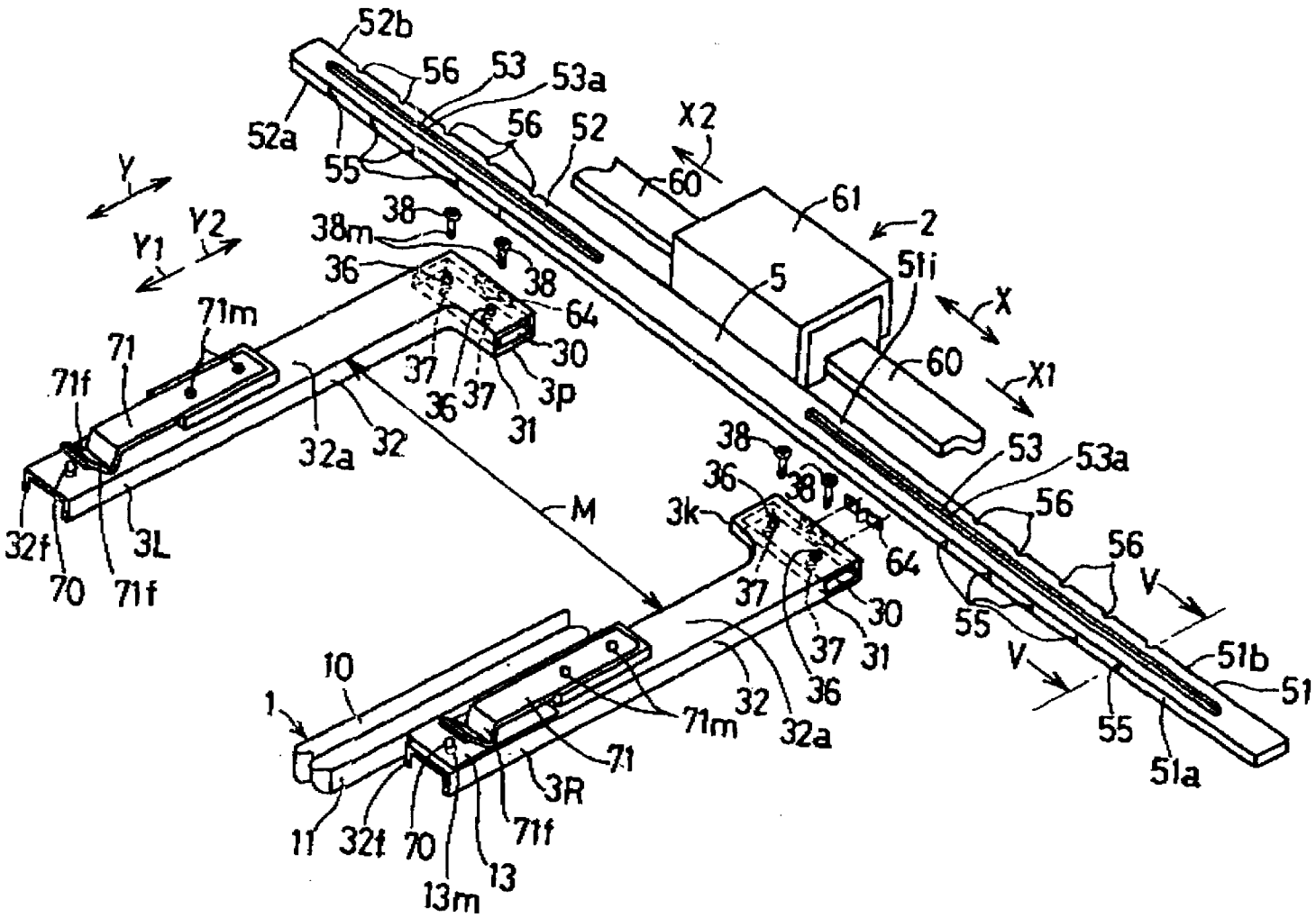
FIG. 8 is a perspective view of an important part of the embroidery frame holding device of a fourth embodiment of the invention.
Figure 9:
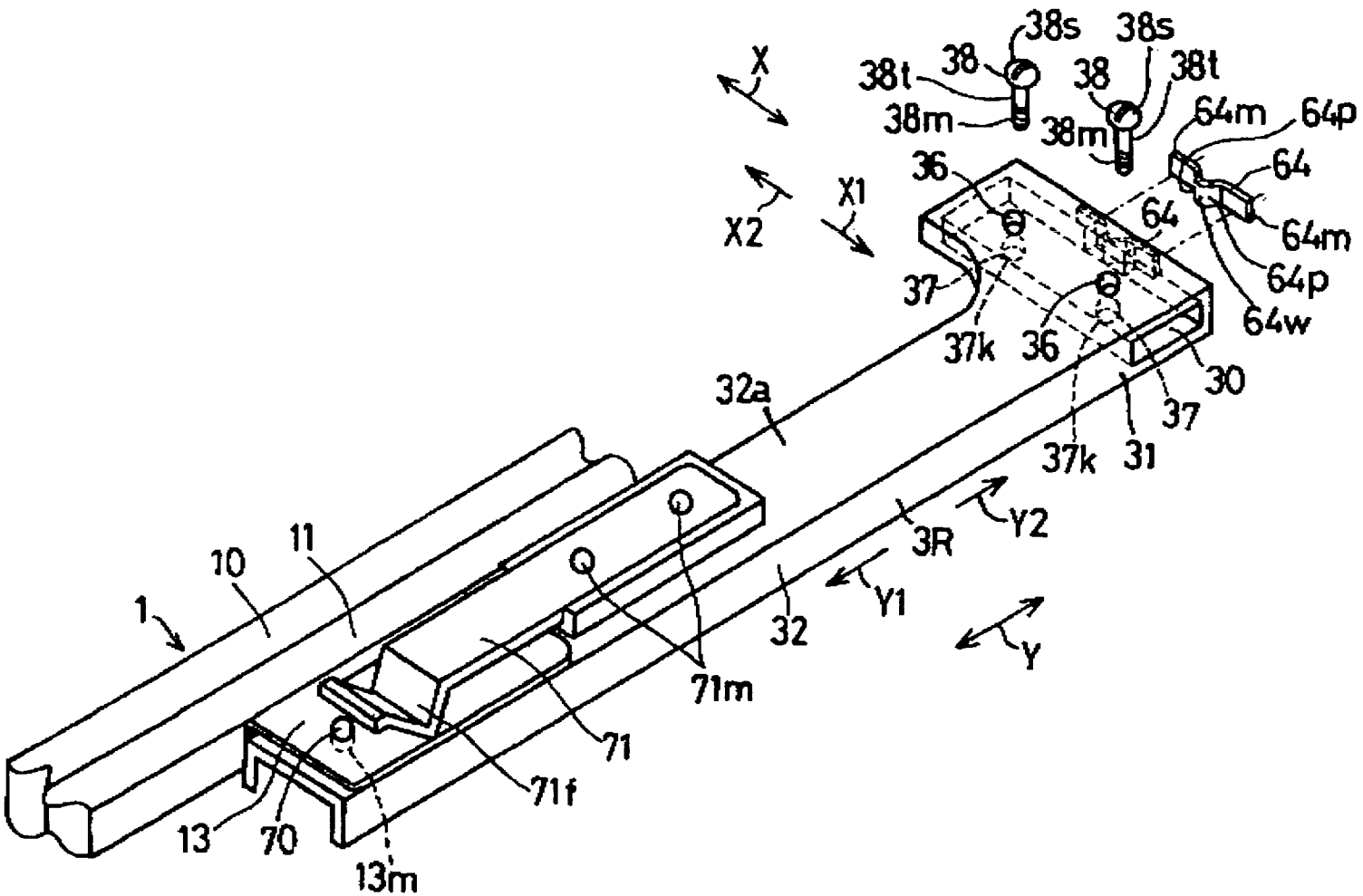
FIG. 9 is a perspective view of an arm of the embroidery frame holding device of the fourth embodiment of the invention.
Figure 10:
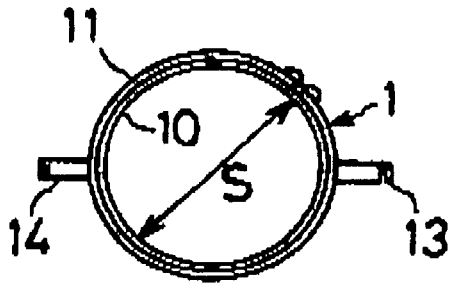
FIG. 10 shows a first example of an embroidery frame usable with the invention.
Figure 11:
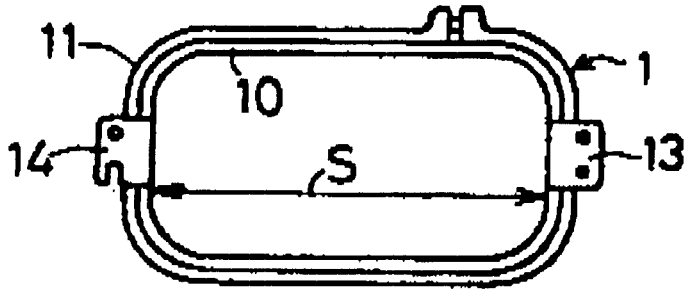
FIG. 11 shows a second example of an embroidery frame usable with the invention.
Figure 12:
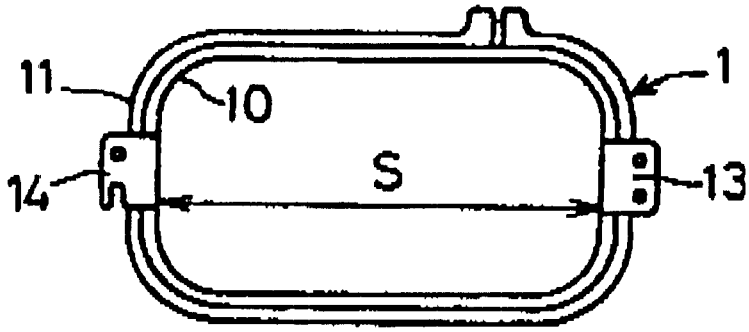
FIG. 12 shows a third example of an embroidery frame usable with the invention.

The fourth embodiment of the present invention is shown in FIG. 8 and FIG. 9. The fourth embodiment is composed basically of the same structure as the first embodiment, and the common parts have the same reference numbers. The fourth embodiment has basically the same advantageous effects. The different parts from the first embodiment will be explained hereunder.

In the fourth embodiment, the top of the first arm 3R and the second arm 3L have positioning pins 70 which project upward, and a holding spring 71 which is constructed from a spring plate and is fixed by the fixation element 71*m*.

In the present invention, the embroidery frame 1 is made as a ring shaped inner frame 10 and a ring shaped outer frame 11, which is adapted to the inner frame 10, is made to detachably hold or clamp a part of the embroidery frame. The first and second installation elements 13 and 14 project to connect to the first arm 3R and the second arm 3L.

As in the first embodiment, when user embroiders, the first installation element 13 of the embroidery frame 1 is fixed to the first arm, and the second installation element of the embroidery frame 1 is fixed to the second arm 3L. Therefore, as with the first embodiment, the first arm 3R and the second arm 3L can slide along the long guide holding part 5 when the arm fixation screw 38 is loosened. In this case, the clearance M between the first arm 3R and the second arm 3L is adjusted as the operator slides the first arm 3R along the long guide holding portion 51 in the X1/X2 direction and slides the second arm 3L along the second long guide holding portion 52 in the direction X1/X2. Therefore the operator can decide the position of the first arm 3R and the second arm 3L in the X direction.

As above explained, if the first arm 3R and the second arm 3L slide along the X1/X2 direction, the embroidery frame 1 can clamp the first arm 3R and the second arm 3L, using the embroidery frame 1 of the different width sizes, and can deal with various sizes S of the embroidery frame 1.

To clamp the embroidery frame 1 to the first arm 3R, as understand in FIG. 8 and FIG. 9, the holding spring 71 of the first arm 3R is lifted and the positioning portion 13*m* of the first installation element 13 of the embroidery frame is adapted to the positioning pin 70. When the holding spring 71 is released, the holding part 71*f* of the holding spring 71 presses on the first installation element 13, and the first installation element 13 press down on the top wall 32*a* of the first arm 3R.

Similarly, to clamp the embroidery frame 1 to the second arm 3L, the holding spring 71 of the second arm 3L is lifted and the positioning portion 13*m* of the second installation element 13 of the embroidery frame is adapted to the positioning pin 70. When the holding spring 71 is released, the holding part 71*f* of the holding spring 71 presses on the second installation element 13, and the second installation element 13 press down on the top wall 32*a* of the second arm 3L.

In the present embodiment, as the arm fixation screw 38 of a side of the first arm 3R screws and tightens on the fixation element 37, the first arm 3R is fixed to the first long guide holding portion 51, and as the arm fixation screw 38 of the second arm 3L screws and tightens on the fixation element 37, the second arm 3L is fixed to the second long guide holding portion 52. In this case, the first arm 3R cannot slide on the first long guide holding portion 51, and the second arm 3L cannot slide on the second long guide holding portion 52.

In the present embodiment, multiple marks 55 showing the high frequency positions of use for the first arm 3R and the second arm 3L are provided on the first long guide holding portion 51 and the second long guide holding portion 52 as a means of arm position discrimination. As is understood, a user can easily slide the arm devices to positions of high frequency use.

In addition to this embodiment of the present invention, the first arm 3R can slide along the first long guide holding portion 51, and the second arm 3L can slide along the second long guide holding portion 52. Namely, since both of the first arm 3R and the second arm 3L can slide, it is much easier to change the width size S of the embroidery frame 1.

Figure 13:
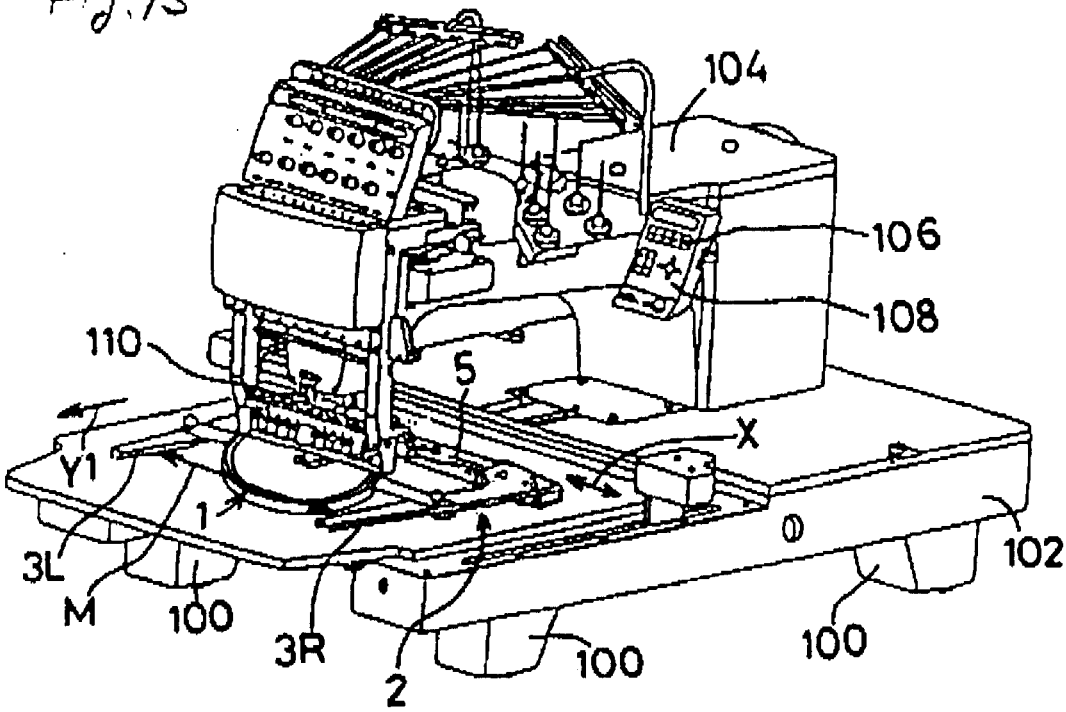
FIG. 13 shows an embroidery machine incorporating an embroidery frame holding device of the invention.

FIG. 13 shows an example of application. In this example of application a base 102 has plural legs 100, a embroidery part 104 has a function of embroidering with a needle drive structure mounted on the base 102, an operating board 108 has various switches 106, an embroidering needle 210 and the embroidery frame holding device 2 to hold the embroidery frame 1.

The embroidery frame holding device 2 has the first arm 3R extending in a direction Y1, the first arm 3R holding a part of the embroidery material, and the second arm 3L holding another part of embroidery material. The long guide holding part 5 is provided along a direction X which intersects an extending direction of the first arm 3R and the second arm 3L. The clearance M between the first arm 3R and the second arm 3L is continuously variable.

Plural marks 55 are provided as an arm position discrimination means on the first long guide holding portion 51 and second long guide holding portion 52. But the number of marks 55 is not limited, and a single mark 55 provided on the first long guide holding portion 51 and the second long guide holding portion 52 may be applicable. Furthermore the mark 55 is not limited to a vertical line but may be a dot, triangle, number, word and so forth.

In the first embodiment of the present invention, the first long guide holding portion 51 and a slide hole 30 have a rectangular shape in cross section. However, they may have a round shape or oval shape, or any shape which can slide the first arm 3R and second arm 3L smoothly.

In the first embodiment of the present invention, the clamp 64 lets a user feel and hear when sliding the first arm 3R or second arm 3L to a frequent use position. The marks 55 on the long guide holding part 5 are also to distinguish the position of the first arm device 3R and second arm 3L when the embroidery frame 1 is in a high frequency use position. However, it is possible to provide only the detent 56 and the clamp 64, and eliminate the marks 55, or to provide only the marks 55 and eliminate the detent 56 and the clamp 64.

In the first embodiment of the present invention, the clamp 64 is provided on the first arm 3R and second arm 3L, and the detents 56 are provided at the long guide holding part 5. However, it may be applicable to provide the detent 56 at the first arm device 3R and second arm device 3L, and to provide the arm with the clamp.

In the first embodiment of the present invention, it is possible to slide the first arm 3R and the second arm 3L along the long guide holding part 5, but it is instead possible for one of them to slide, and for the other of them not to slide.

The present invention is not restricted or confined to the embodiments explained in the above and shown in the drawings. The first arm and second arm can be fixed to the long guide holding portion, for example, by using pressure contact. Alternatively, the first arm and second arm may be screwed to the long guide holding portion.

Each of the embroidery machine and the embroidery material holding device can be provided with a fixation portion which has a hole having internal threading at the wall of either part of the first arm and second arm, and a screw matable with the internal threading.

Each of the embroidery machine and the embroidery material holding device can be provided with a box type base portion which blocks out the slide hole connected with the long guide holding portion with a cross section of either part of the first arm and the second arm.

The long guide holding part has a flat shape. By screwing in the tip of a screw, a pressure is applied to the long guide holding part such that either a part of the first arm or second arm makes contact with the long guide holding part with pressure, to fix either arm to the long guide holding part.

The embroidery machine and the embroidery material holding device can be provided with a means of distinguishing arm position at a sliding position of the arm device, a means for distinguishing arm position with visual discrimination of when the first arm or second arm is at a high frequency use position, a mean for auditory distinguishing when the first arm or second arm is at a high frequency use position, and a mean for distinguishing arm position with by tactile impression when the first arm or second arm is in high frequency use position.

Each of the embroidery machine and the embroidery material holding device can be provided with a shallow dent and convexity portion on the long guide holding portion and at either part of first arm and second arm.

The first arm and second arm may be independent and substantially in parallel.

The first arm, second arm and the long guide holding portion may be in a shape of a horseshoe when the distance between the first arm and second arm is expanded.

The embroidery machine and the embroidery material holding device can be provided with means for distinguishing the position by a detent in the shape of shallow dent or convexity, a mark made at the front side of the long guide holding portion, or a detent made at the back surface of the long guide holding portion.

One side can slide, for example between ¼ to 5 times the length of movement of the other side. The long guide holding part can comprise the first long guide holding portion for sliding the first arm and the second long guide holding portion for sliding the second arm. The first long guide holding portion may have a length of between ¼ to 5 times or ⅓ to 3 times that of the first arm, and the second long guide holding portion length may be between ¼ to 5 times or ⅓ to 3 times that of the second arm.

As it is understood from the above explanation, according to the present invention, by sliding either the first arm or the second arm, the clearance between the first arm and second arm can be adjustable continuously to be wide, medium or narrow. So any width size of embroidery material can be sewn and embroidered.

Obviously, numerous modifications and variations of the present invention are possible in light of the above teachings. It is therefore to be understood that the invention may be practiced otherwise than as specifically described herein.

I claim:

1. An embroidery machine comprising:

an embroidery frame holding device including a first arm which projects in a first horizontal direction and which is adapted to hold a part of an embroidery frame, and a second arm which projects in said first direction and which is adapted to hold another part of the embroidery frame;

a movement part mechanically driven to move in a second horizontal direction which intersects the first direction;

a guide holding part fixedly connected to the movement part;

at least one of the first arm and the second arm being slidably mounted on the guide holding part for movement in said second direction such that a distance between the first arm and the second arm may be varied; and a releasable fixing device mounted to releasably fix at least one of the first arm and the second arm in at least one desired position on said guide holding part.

2. An embroidery machine in accordance with claim 1, wherein both of the first arm and the second arm are slidably mounted on the guide holding part for movement in said second direction such that a distance between the first arm and the second arm may be varied, and wherein said releasable fixing device is mounted to releasably fix both of the first arm and the second arm at desired positions on said guide holding part.

3. An embroidery machine comprising:

an embroidery frame holding device including a first arm which projects in a first direction and which is adapted to hold a part of an embroidery frame, and a second arm which projects in said first direction and which is adapted to hold another part of the embroidery frame;

a guide holding part which is elongated in a second direction which intersects said first direction;

at least one of the first arm and the second arm being slidably mounted on the guide holding part for movement in said second direction such that a distance between the first arm and the second arm may be varied; and a releasable fixing device mounted to releasably fix at least one of the first arm and the second arm in at least one desired position on said guide holding part, wherein the guide holding part includes a visual arm position distinguishing device for at least one of the first arm and the second arm.

4. An embroidery machine in accordance with claim 2, wherein the guide holding part includes a visual arm position distinguishing device for the first arm and the second arm.

5. An embroidery machine comprising:

an embroidery frame holding device including a first arm which projects in a first direction and which is adapted to hold a part of an embroidery frame, and a second arm which projects in said first direction and which is adapted to hold another part of the embroidery frame;

a guide holding part which is elongated in a second direction which intersects said first direction;

at least one of the first arm and the second arm being slidably mounted on the guide holding part for movement in said second direction such that a distance between the first arm and the second arm may be varied; and a releasable fixing device mounted to releasably fix at least one of the first arm and the second arm in at least one desired position on said guide holding part, wherein the guide holding part includes an auditory arm position distinguishing device for at least one of the first arm and the second arm.

6. An embroidery machine in accordance with claim 2, wherein the guide holding part includes an auditory arm position distinguishing device for the first arm and the second arm.

7. An embroidery machine in accordance with claim 1, wherein the guide holding part includes a tactile arm position distinguishing device for at least one of the first arm and the second arm.

8. An embroidery machine in accordance with claim 2, wherein the guide holding part includes a tactile arm position distinguishing device for the first arm and the second arm.

9. An embroidery machine comprising:

an embroidery frame holding device including a first arm which projects in a first horizontal direction and which is adapted to hold a part of an embroidery frame, and a second arm which projects in said first direction and which is adapted to hold another part of the embroidery frame;

a movement part mechanically driven to move in a second horizontal direction which intersects the first direction;

a guide holding part fixedly connected to the movement part;

at least one of the first arm and the second arm being slidably mounted on the guide holding part for movement in said second direction such that a distance between the first arm and the second arm may be varied; and releasable fixing means for releasably fixing at least one of the first arm and the second arm in at least one desired position on said guide holding part.

10. An embroidery machine in accordance with claim 9, wherein both of the first arm and the second arm are slidably mounted on the guide holding part for movement in said second direction such that a distance between the first arm and the second arm may be varied, and wherein said releasable fixing means comprises means for releasably fixing both of the first arm and the second arm at desired positions on said guide holding part.

11. An embroidery machine comprising:

an embroidery frame holding device including a first arm which projects in a first direction and which is adapted to hold a part of an embroidery frame, and a second arm which projects in said first direction and which is adapted to hold another part of the embroidery frame;

a guide holding part which is elongated in a second direction which intersects said first direction;

at least one of the first arm and the second arm being slidably mounted on the guide holding part for movement in said second direction such that a distance between the first arm and the second arm may be varied; and releasable fixing means for releasably fixing at least one of the first arm and the second arm in at least one desired position on said guide holding part, wherein the guide holding part includes a visual arm position distinguishing device for at least one of the first arm and the second arm.

12. An embroidery machine in accordance with claim 10, wherein the guide holding part includes a visual arm position distinguishing device for the first arm and the second arm.

13. An embroidery machine in accordance with claim 10, wherein the guide holding part includes auditory arm position distinguishing means for at least one of the first arm and the second arm.

14. An embroidery machine in accordance with claim 10, wherein the guide holding part includes auditory arm position distinguishing means for the first arm and the second arm.

15. An embroidery machine in accordance with claim 9, wherein the guide holding part includes tactile arm position distinguishing means for at least one of the first arm and the second arm.

16. An embroidery machine in accordance with claim 10, wherein the guide holding part includes tactile arm position distinguishing means for the first arm and the second arm.

17. An embroidery frame holding device comprising:

a first arm which projects in a first horizontal direction and which is adapted to hold a part of an embroidery frame;

a second arm which projects in said first direction and which is adapted to hold another part of the embroidery frame;

a movement part mechanically driven to move in a second horizontal direction which intersects the first direction;

a guide holding part fixedly connected to the movement part;

at least one of the first arm and the second arm being slidably mounted on the guide holding part for movement in said second direction such that a distance between the first arm and the second arm may be varied; and a releasable fixing device mounted to releasably fix at least one of the first arm and the second arm in at least one desired position on said guide holding part.

18. An embroidery frame holding device in accordance with claim 17, wherein both of the first arm and the second arm are slidably mounted on the guide holding part for movement in said second direction such that a distance between the first arm and the second arm may be varied, and wherein said releasable fixing device is mounted to releasably fix both of the first arm and the second arm at desired positions on said guide holding part.

19. An embroidery frame holding device comprising:

a first arm which projects in a first direction and which is adapted to hold a part of an embroidery frame;

a second arm which projects in said first direction and which is adapted to hold another part of the embroidery frame;

a guide holding part which is elongated in a second direction which intersects said first direction;

at least one of the first arm and the second arm being slidably mounted on the guide holding part for movement in said second direction such that a distance between the first arm and the second arm may be varied; and a releasable fixing device mounted to releasably fix at least one of the first arm and the second arm in at least one desired position on said guide holding part, wherein the guide holding part includes a visual arm position distinguishing device for at least one of the first arm and the second arm.

20. An embroidery frame holding device in accordance with claim 18, wherein the guide holding part includes a visual arm position distinguishing device for the first arm and the second arm.

21. An embroidery frame holding device comprising:

a first arm which projects in a first direction and which is adapted to hold a part of an embroidery frame;

a second arm which projects in said first direction and which is adapted to hold another part of the embroidery frame;

a guide holding part which is elongated in a second direction which intersects said first direction;

at least one of the first arm and the second arm being slidably mounted on the guide holding part for movement in said second direction such that a distance between the first arm and the second arm may be varied; and a releasable fixing device mounted to releasably fix at least one of the first arm and the second arm in at least one desired position on said guide holding part, wherein the guide holding part includes an auditory arm position distinguishing device for at least one of the first arm and the second arm.

22. An embroidery frame holding device in accordance with claim 18, wherein the guide holding part includes an auditory arm position distinguishing device for the first arm and the second arm.

23. An embroidery frame holding device in accordance with claim 17, wherein the guide holding part includes a tactile arm position distinguishing device for at least one of the first arm and the second arm.

24. An embroidery frame holding device in accordance with claim 18, wherein the guide holding part includes a tactile arm position distinguishing device for the first arm and the second arm.

25. An embroidery frame holding device comprising:

a first arm which projects in a first horizontal direction and which is adapted to hold a part of an embroidery frame;

a second arm which projects in said first direction and which is adapted to hold another part of the embroidery frame;

a movement part mechanically driven to move in a second horizontal direction which intersects the first direction;

a guide holding part fixedly connected to the movement part;

at least one of the first arm and the second arm being slidably mounted on the guide holding part for movement in said second direction such that a distance between the first arm and the second arm may be varied; and releasable fixing means for releasably fixing at least one of the first arm and the second arm in at least one desired position on said guide holding part.

26. An embroidery frame holding device in accordance with claim 25, wherein both of the first arm and the second arm are slidably mounted on the guide holding part for movement in said second direction such that a distance between the first arm and the second arm may be varied, and wherein said releasable fixing means comprises means for releasably fixing both of the first arm and the second arm at desired positions on said guide holding part.

27. An embroidery frame holding device comprising:

a first arm which projects in a first direction and which is adapted to hold a part of an embroidery frame;

a second arm which projects in said first direction and which is adapted to hold another part of the embroidery frame;

a guide holding part which is elongated in a second direction which intersects said first direction;

at least one of the first arm and the second arm being slidably mounted on the guide holding part for movement in said second direction such that a distance between the first arm and the second arm may be varied; and releasable fixing means for releasably fixing at least one of the first arm and the second arm in at least one desired position on said guide holding part, wherein the guide holding part includes a visual arm position distinguishing device for at least one of the first arm and the second arm.

28. An embroidery frame holding device in accordance with claim 26, wherein the guide holding part includes a visual arm position distinguishing device for the first arm and the second arm.

29. An embroidery frame holding device comprising:

a first arm which projects in a first direction and which is adapted to hold a part of an embroidery frame;

a second arm which projects in said first direction and which is adapted to hold another part of the embroidery frame;

a guide holding part which is elongated in a second direction which intersects said first direction;

at least one of the first arm and the second arm being slidably mounted on the guide holding part for movement in said second direction such that a distance between the first arm and the second arm may be varied; and releasable fixing means for releasably fixing at least one of the first arm and the second arm in at least one desired position on said guide holding part, wherein the guide holding part includes auditory arm position distinguishing means for at least one of the first arm and the second arm.

30. An embroidery frame holding device in accordance with claim 26, wherein the guide holding part includes auditory arm position distinguishing means for the first arm and the second arm.

31. An embroidery frame holding device in accordance with claim 25, wherein the guide holding part includes tactile arm position distinguishing means for at least one of the first arm and the second arm.

32. An embroidery frame holding device in accordance with claim 26, wherein the guide holding part includes tactile arm position distinguishing means for the first arm and the second arm.

* * * * *